United States Patent [19]

Urano et al.

[11] Patent Number: 4,790,875

[45] Date of Patent: Dec. 13, 1988

[54] ABRASION RESISTANT SINTERED ALLOY

[75] Inventors: Shigeru Urano, Omiya; Osamu Hirakawa, Yono, both of Japan

[73] Assignee: Nippon Piston Ring Co., Ltd., Tokyo, Japan

[21] Appl. No.: 158,106

[22] PCT Filed: Mar. 23, 1984

[86] PCT No.: PCT/JP84/00121

§ 371 Date: Apr. 1, 1985

§ 102(e) Date: Apr. 1, 1985

[87] PCT Pub. No.: WO85/00836

PCT Pub. Date: Feb. 28, 1985

Related U.S. Application Data

[63] Continuation of Ser. No. 722,223, Apr. 1, 1985, abandoned.

[30] Foreign Application Priority Data

Aug. 3, 1983 [JP] Japan ..... 58-140964

[51] Int. Cl.[4] ..... C22C 29/06

[52] U.S. Cl. ..... 75/241; 75/231; 419/47

[58] Field of Search ..... 75/241, 241; 419/47

[56] References Cited

U.S. PATENT DOCUMENTS

| | | | |
|---|---|---|---|
| 1,252,596 | 1/1918 | McMillin | 420/100 |
| 2,575,218 | 11/1951 | Giles | 420/100 |
| 2,709,132 | 5/1955 | Giles | 420/17 |
| 3,367,770 | 2/1968 | Fletcher et al. | 420/11 |
| 3,692,515 | 9/1972 | Fletcher et al. | 420/11 |
| 3,859,083 | 1/1975 | Kusaka et al. | 420/42 |
| 3,977,838 | 8/1976 | Hashimoto et al. | 75/246 |
| 4,035,159 | 7/1977 | Hashimoto et al. | 420/100 |
| 4,110,514 | 8/1978 | Nicholson | 420/100 |
| 4,125,399 | 11/1978 | Kizu et al. | 420/14 |
| 4,150,978 | 4/1979 | Schlatter et al. | 420/42 |
| 4,194,906 | 5/1980 | Krantz et al. . | |
| 4,224,060 | 9/1980 | de Souza et al. | 420/100 |
| 4,236,923 | 12/1980 | Takahashi et al. | 419/6 |
| 4,243,414 | 1/1981 | Takahashi et al. | 75/244 |
| 4,334,926 | 6/1982 | Futamura et al. | 75/238 |
| 4,338,128 | 7/1982 | Farge et al. . | |
| 4,345,943 | 8/1982 | Takahashi et al. | 75/238 |
| 4,363,662 | 12/1982 | Takahashi et al. | 75/243 |
| 4,388,114 | 6/1983 | Suganuma et al. | 75/243 |
| 4,395,284 | 7/1983 | Dawson . | |
| 4,433,032 | 2/1984 | Nakamura et al. | 420/9 |
| 4,491,477 | 1/1985 | Suganuma et al. | 75/243 |
| 4,505,988 | 3/1985 | Urano et al. | 75/243 |

FOREIGN PATENT DOCUMENTS 38930 3/1980 Japan .

*Primary Examiner*—John F. Terapane
*Assistant Examiner*—Eric Jorgensen
*Attorney, Agent, or Firm*—Birch, Stewart, Kolasch & Birch

[57] ABSTRACT

An abrasion resistant alloy sintered in a liquid phase, which contains, by weight, 1.5 to 4.0% C, 0.5 to 1.2% Si, 1.0% or less Mn, 2.0 to less than 20.0% Cr, 0.5 to 2.5% Mo, 0.2 to 0.8% P, and the balance of Fe. The alloy is suitable for fabricating sliding parts in internal combustion engines, such as valve mechanisms.

17 Claims, 1 Drawing Sheet

ABRASION RESISTANT SINTERED ALLOY

This application is a continuation of application Ser. No. 722,223 filed on Apr. 1, 1985, now abandoned. This application is also entitled to benefit of PCT International application PCT/JP84/00121 filed on Mar. 23, 1984.

TECHNICAL FIELD

The present invention relates to a chromium-containing iron-base sintered alloy which is used as material for sliding parts in internal combustion engines, such as valve mechanisms.

BACKGROUND ART

Recently, the valve mechanisms of internal combustion engines have been required to bear heavy running loads. In particular, sliding parts, such as a camshafts and rocker arms, have been required to stand up against high plane pressures. Chromium-containing iron-base sintered alloys have been utilized in sliding parts not only to meet the aforementioned requirements but also to reduce the weight of the parts.

Such alloys are disclosed by JP A No. 54-62108, JP A No. 56-123353 (corresponding to U.S. Pat. No. 4,388,114) and JP A No. 58-37158. The alloy disclosed in 54-62108, contain, by weight, Cr, 8.0–30.0%; C, 0.5–4.0%; P, 0.2–0.3%, the balance being Fe. A problem arises with this alloy when the chromium exceeds 20.0% since the chromium-carbide grows coarser and harder which damages to opposing sliding parts. Another problem that arises is that it is too hard to be machined. The alloy of disclosed in No. 56-12353, contains, by weight, Cr, 2.5–7.5%; Cu, 1.0–5.0%; C, 1.5–3.5%; P, 0.2–0.8%; Si, 0.5–2.0%; Mn, 0.1–3.0%; Mo, less than 3.0%, the balance being Fe. This alloy is less shrinkable even when sintered at a liquid-phase since it contains more than 1% of copper. Thus, it is unavailable for fabricating the fitting members of a camshaft, such as cam lobes and the like, which are constrictively jointed to the shaft after being loosely mounted on the same. The alloy disclosed in No. 58-37158, contains, by weight, Cr, 2.5–25.0%; C, 1.5–3.5%; Mn, 0.1–3.0%; P, 0.1–0.8%; Cu, 1.0–5.0%; Si, 0.5–2.0%; Mo, less than 3.0%; S, 0.5–3.0%; Pb, 1.0–5.0%; the balance being Fe. This alloy has an advantage since copper is effective in preventing the growth of coarse chromium-carbide. However, it is relatively brittle because it contains sulphide and lead.

The present invention is intended to provide a chromium-containing iron-base sintered alloy that is superior in machinability and suitable for fabricating cam lobes and the like which are constrictively bonded to a shaft by liquid-phase sintering after being loosely mounted on the same shaft.

DISCLOSURE OF INVENTION

The liquid-phase sintered alloy according to the present invention contains, by weight, C, 1.5–4.0%; Si, 0.5–1.2%; Mn, no more than 1.0%; Cr, a range of 2.0% to less than 20.0%; Mo, 0.5%–2.5%; P, 0.2–0.8%, the balance being Fe. The alloy may have either of 0.5–2.5%, by weight, of nickel or no more than 0.85%, by weight, of copper, in addition to the aforementioned elements. It may additionally have 0.5–2.5%, by weight, of nickel along with 0.1–4.0%, by weight, of copper. It may contain other additional components, in the amount of 0.1–5.0%, by weight, selected from a group consisting of B, V, Ti, Nb and W.

The reason for a content range of 1.5–4.0% by weight of carbon is that, when the content of carbon exceeds 4.0%, the chromium-carbide grows coarser and harder which produces large pores and results in an alloy matrix that is somewhat brittle after being sintered, When carbon is below 1.5%, the amount of chromium-carbide is insufficient to give the abrasion-resistant property to the alloy.

The reason for a content range of 0.5–1.2% by weight of silicon is that, when silicon exceeds 1.2%, the alloy powders become less moldable and more deformable when sintered, causing the sintered alloy matrix to become brittle. silicone is an important component and yields a liquid-phase when carbon and phosphorus are relatively low in content, so that its content should not be less than 0.5%.

The reason for a content of no more than 1.0% by weight of manganese is that, when manganese exceeds 1.0%, the alloy powders become less moldable and the sintering rate reduces to such an extent that there remain large pores in the sintered alloy.

The reason for limiting the chromium content to less than 20.0% by weight is that more than 20.0% of chromium the chromium carbide grows coarser and harder which decreases the machinability of the alloy. The addition of less than 2.0% by weight of chromium is also undesirable because it will result in an insufficient formation of hard carbide, thereby deteriorating the anti-wearing property. It is preferable to increase carbon content with chromium content in alloys used in sliding parts which are subject to the high plane pressures of automobile engines under heavy running loads, although carbon content is usually decreased with chromium content.

Molybdenum is solid-solved in the matrix to increase the hardness as well as the wear resistance of the sintered alloy. This effect is exaggerated if the molybdenum content is in an amount greater than 2.5% by weight. However, the hardness and wear-resistant effect is too small if the amount is less than 0.5% by weight. Thus, the amount of molybdenum is limited to 0.5 to 2.5% by weight.

Phosphorus contributes to the precipitation of Fe-C-P eutectic steadite, which has a high hardness and a low solidifying point of about 950 degrees which promotes the liquid-phase sintering. If the amount of phosphorus is less than 0.2% by weight, the precipitation of steadite is too small to obtain a high anti-wearing alloy. Further, it is not as easy to yield a liquid-phase. However, if the amount of phosphorus exceeds 0.8% by weight, the machinability of the alloy will decrease due to excessively produced steadite. Thus, the amount of phosphorus is limited to 0.2 to 8.0% by weight.

The purpose of adding nickel is to enlarge the amount of martensite and bainite in the matrix and increase the tensile strength. However, if the addition of nickel exceeds 2.5T by weight, the increase of residual austenite in the matrix decreases the hardness and abrasion-resistance. The addition of less than 0.5% by weight of nickel is not effective in increasing the tensile strength. Thus, the amount of nickel is limited to 0.5% to 2.5% by weight.

The purpose of adding at least one element selected from the group consisting of B, V, Ti, Nb and W is to promote a yield of liquid phase as a well as formation of carbide. The amount added is desirably limited to 0.1 to 5.0% by weight taking into consideration the hardness of the opposite sliding part.

It is preferred that less than 300 PPM of calcium is added to improve the machinability of the alloy.

The alloy of the invention is generally used in slidable parts of camshafts and rocker arms, and is conveniently sintered at a liquid-phase yielding temperature. The reason for this is that the sinterable alloy powder preform, after being loosely mounted on the shaft, contracts and tightly joins to the shaft by the liquid-phase sintering. For example cam lobes of sinterable alloy powders are loosely mounted on a steel shaft and then sintered at a liquid-phase yielding temperature in which the cam lobe is firmly bonded to the shaft and its density highly increased.

THE BEST MODE OF CARRYING OUT THE INVENTION

The preferred examples of the present invention are illustrated below.

EXAMPLE 1

Figure 2:
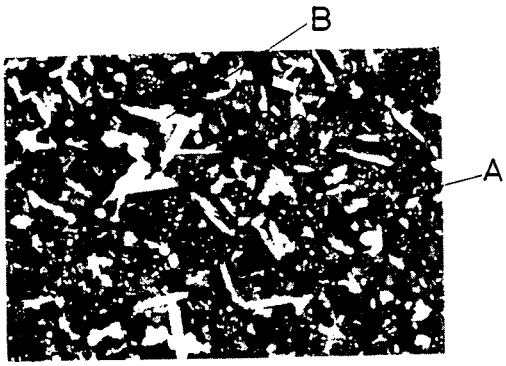

Alloy powders are prepared to have the following composition, by weight, 2.8% of C, 0.9% of Si, 0.2% of Mn, 0.5% of P, 15.5% of Cr, 1.9% of Ni, 1.0% of Mo, the balance being Fe. These elements are mixed together with zinc stearate. The mixture is compressed under a compression pressure of 5 to 7 t/sq. cm and then sintered at 1100 to 1200 degrees (average 1160 degrees) in cracked ammonia gas atmosphere furnace, thereby yielding a sintered alloy as micrographically shown in FIG. 2 in which white carbides are granularly distributed over the black matrix consisting of a martensite and bainite mixture. The test results show that the alloy has a hardness of HRC 61.5, a density of 7.62 g/cu. cm, and a superior abrasion-resistant property.

EXAMPLE 2

Figure 1:
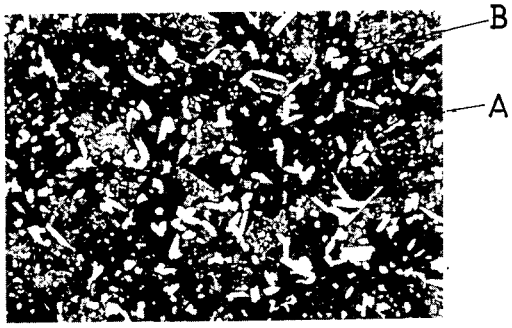
FIGS. 1 and 2 are photomicrographs of a magnification of 200 showing the microstructure of the abrasion-resistant alloy of the invention. The reference marks A and B indicate the matrix carbide, respectively.

Other alloy powders are prepared to have the following composition, by weight, of 2.0% of C, 0.8% of Si, 0.15% of Mn, 0.45% of P, 6.0% of Cr, 1.6% of Ni, 1.0% of Mo, the balance being Fe. These elements are mixed together with zinc stearate. The mixture is compressed under a compression pressure of 5 to 7 t/sq. cm and then sintered at 1050 to 1180 degrees (average 1120 degrees) in cracked ammonia gas atmosphere furnace, thereby yielding a sintered alloy as micrographically shown in FIG. 1 in which white carbides B are granularly distributed over the black matrix A consisting of a martensite and bainite mixture. The test results show that the alloy had a hardness of HRC 56.5, a density of 7.60 g/cu. cm, and a superior abrasion-resistant property.

From the foregoing the ferrous sintered alloy of the invention has a structure composed of a martensite and banite mixture matrix as yielded by a liquid-phase sintering and carbides granularly speed out in the matrix. It therefore has a superior anti-wearing property. The alloy also has a superior fitting property and is easily produced, because the powders are molded and firmly bonded to a body by a liquid-phase sintering. The alloy advantageously contains less than 20% by weight of chromium, so that coarse and hard chromium-carbide is prevented from growing to the extent that it damages to the opposite sliding part. Further, the alloy is less brittle since it contains neither sulphide nor lead.

INDUSTRIAL APPLICABILITY

The anti-wear alloy of the invention is available as a material for fabricating sliding members in an internal combustion engine such as cams on a camshaft and tapets on a rocker arm.

We claim:

1. An abrasion-resistant sintered alloy containing, by weight, 1.5 to 4.0% of carbon, 0.5 to 1.2% of silicon, 1.0% or less of manganese, 2.0 to less than 20.0% of chromium, 0.5 to 2.5% of molybdenum, 0.2 to 0.8% of phosphorus, 0.5 to 2.5% of nickel, and the balance being iron, said alloy being sintered in a liquid-phase, and said alloy containing carbides granularly distributed in a base structure that comprises a matrix of martensite and bainite.

2. The alloy as claimed in claim 1, wherein the contents of carbon and chromium are respectively limited to 1.5 to 3.0% and 2.0 to less than 8.0%.

3. The alloy as claimed in claim 2, further containing no more than 0.85% of copper.

4. The alloy as claimed in claim 3, additionally containing 0.1 to 5.0% of at least one element selected from the group consisting of boron, vanadium, titanium, and tungsten.

5. The alloy as claimed in claim 2, further containing 0.5 to 2.5% of nickel and 1.0 to 4.0% of copper.

6. The alloy as claimed in claim 5, additionally containing 0.1 to 5.0% of at least one element selected from the group consisting of boron, vanadium, titanium, and tungsten.

7. The alloy as claimed in claim 1, wherein the contents of carbon and chromium are respectively limited to 2.0 to 4.0% and 8.0 to less than 20.0%.

8. The alloy as claimed in claim 7, further containing no more than 0.85% of copper.

9. The alloy as claimed in claim 3, further containing 0.5 to 2.5% of nickel and 1.0 to 4.0% of copper.

10. The alloy as claimed in claim 7, additionally containing 0.1 to 5.0% of at least one selected from a group consisting of B, V. Ti, and W.

11. The alloy as claimed in claim 2, additionally containing 0.1 to 5.0% of at least one element selected from the group consisting of boron, vanadium, titanium, and tungsten.

12. The alloy as claimed in claim 1, additionally containing 0.1 to 5.0% of at least one element selected from the group consisting of boron, vanadium, titanium, and tungsten.

13. The alloy as claimed in claim 1, additionally containing 0.1 to 5.0% of at least one element selected from the group consisting of boron, vanadium, titanium, and tungsten.

14. The alloy as claimed in claim 1 containing, by weight, 2.8% of carbon, 0.9% of silicon, 0.2% of manganese, 15.5% of chromium, 1.0% of molybdenum, 0.5% of phosphorus, 1.9% of nickel, and the balance being iron.

15. The alloy as claimed in claim 1 containing, by weight, 2.0% of carbon, 0.8% of silicon, 0.15% of manganese, 6.0% of chromium, 1.0% of molybdenum, 0.45% of phosphorus, 1.6% of nickel, and the balance being iron.

16. An abrasion-resistant sintered alloy consisting essentially of, by weight, 1.5 to 4.0% of carbon, 0.5 to 1.2% of silicon, 1.0% or less of manganese, 2.0 to less than 20.0% of chromium, 0.5 to 2.5% of molybdenum, 0.2 to 0.8% of phosphorus, 0.5 to 2.5% of nickel, and the balance being iron, said alloy being sintered in a liquid-phase.

17. An abrasion-resistant sintered alloy consisting essentially of, by weight, 1.5 to 4.0% of carbon, 0.5 to 1.2% of silicon, 1.0% or less of manganese, 2.0 to less than 20.0% of chromium, 0.5 to 2.5% of molybdenum, 0.2 to 0.8% of phosphorus, 0.5 to 2.5% of nickel, and the balance being iron, said alloy being sintered in a liquid-phase, and said alloy consisting essentially of carbides granularly distributed in a base structure that is a matrix of martensite and bainite.

* * * * *